US005827463A

United States Patent [19]

Rüf

[11] Patent Number: 5,827,463

[45] Date of Patent: Oct. 27, 1998

[54] PROCESS FOR MANUFACTURING CELLULOSE MOULDED BODIES

[75] Inventor: Hartmut Rüf, Vöcklabruck, Austria

[73] Assignee: Lenzing Aktiengesellschaft, Lenzing, Austria

[21] Appl. No.: 633,754

[22] PCT Filed: Sep. 4, 1995

[86] PCT No.: PCT/AT95/00174

§ 371 Date: Jun. 21, 1996

§ 102(e) Date: Jun. 21, 1996

[87] PCT Pub. No.: WO96/07779

PCT Pub. Date: Mar. 14, 1996

[30] Foreign Application Priority Data

Sep. 5, 1994 [AT] Austria ..... A 1695/94

[51] Int. Cl.[6] ..... D01F 2/02

[52] U.S. Cl. ..... 264/187; 264/203

[58] Field of Search ..... 264/187, 203

[56] References Cited

U.S. PATENT DOCUMENTS

| | | | |
|---|---|---|---|
| 4,246,221 | 1/1981 | McCorsley | 264/203 |

FOREIGN PATENT DOCUMENTS

| | | |
|---|---|---|
| 134893 | 7/1993 | Austria . |
| 538977 | 3/1992 | European Pat. Off. . |
| 553070 | 1/1993 | European Pat. Off. . |
| 218121 | 1/1985 | Germany . |
| 1224362 | 4/1986 | U.S.S.R. . |
| 92/07124 | 4/1992 | WIPO . |
| 94/09191 | 4/1994 | WIPO . |
| 94/20656 | 9/1994 | WIPO . |

OTHER PUBLICATIONS

Romanov et al., Khim. Volokna, 1, p. 29 (1989).

Romanov et al., Khim. Volokna, 4, p. 33 (1989).

Romanov et al., Khim. Volokna, 1, p. 27 (1988).

Quenin, "Precipitation de la, cellulose à partirde solutions dans les oxydes d amines tertiares: application au filage", Dissertation Grenoble (1985).

Dube et al.,. "Precipitation and crystallization of cellulose from amine oxide solutions", TAPPI Proc. International and Dissolving Specialty Pulps, Boston (1983).

Weigel et al., "Challenges in Cellulosic Man–Made Fibres", Viscose Chemistry Seminar, Stockholm (1994) Seminar, Stockholm (1994).

English Translation of Austrian Patent Application 1348/93.

English Abstract of European Published Application No. EP 553070.

English Abstract of German Patent No. DD 255,711.

German Translation of Romanov et al. Khim, Volokna, 4, p. 33.

*Primary Examiner*—Leo B. Tentoni

*Attorney, Agent, or Firm*—Baker & Botts LLP

[57] ABSTRACT

The disclosure describes a process for the manufacture of cellulosic moulded bodies in which cellulose is dissolved in a mixture of a tertiary amine oxide and a non-solvent for cellulose, e.g. water. The solution is extruded via a moulding tool and the filaments received are led via an air gap to a precipitation bath whilst being drawn. The process is characterised in that the precipitation bath substantially comprises a non-aqueous solvent for the tertiary amine oxide, whereby the molecular weight of the non-aqueous solvent is larger than that of the tertiary amine oxide. In this manner, solvent-spun fibers with a lower fibrillation tendency can be obtained. Polyethylene glycols are preferably used.

8 Claims, No Drawings

PROCESS FOR MANUFACTURING CELLULOSE MOULDED BODIES

BACKGROUND OF THE INVENTION

This invention relates to a process for the manufacture of cellulose moulded bodies in which cellulose is dissolved in a mixture of a tertiary amine oxide and a non-solvent. The solution of cellulose is extruded via a moulding tool thereby forming filaments which are conveyed through an air gap into a precipitation bath while being drawn.

In the course of the last decades, as a result of environmental problems concerning the established viscose process for the manufacture of cellulosic fibres, intensive effort was invested in providing alternative more environment friendly processes. One particularly interesting possibility which has crystallized in the last couple of years is the dissolving of cellulose without the development of a derivative in an organic solvent and extruding moulded bodies from this solution. Spun fibres of this type received the generic name Lyocell from BISFA (The International Bureau for the Standardization of Man-Made Fibres) whereby a mixture of an organic chemical and water is meant by an organic solvent.

It has been shown that a mixture of tertiary amine oxide and water are excellent as an organic solvent for the manufacture of Lyocell fibres. In the main, N-methyl morpholine-N-oxide (NMMO) is used as the amine oxide. Other suitable amine oxides are disclosed in EP-A 553 070. Processes for the manufacture of cellulosic moulded bodies from a solution of cellulose in a mixture of NMMO and water are for example disclosed in U.S. Pat. No. 4,246,221. Fibres manufactured in this way are characterised by a high fibre tenacity in the conditioned and wet state, a high wet modulus and a high loop strength.

A special characteristic of these fibres is their high tendency to fibrillation, particularly when under stress in a wet state such as for example during a washing operation. Whilst this property is absolutely desirable for certain fibre applications and produces interesting effects, the usefulness regarding other ends such as for example in textiles, which should show wash resistance, is reduced.

Therefore, no effort was spared in the attempt to reduce fibrillation behaviour using certain measures.

In PCT-WO 92/07124, the suggestion was made to treat a freshly spun, not yet dried, fibre with the solution of a polymer containing several cationic sites.

According to EP-A-538977, the fibres, which can be freshly spun or already dried, are treated with an aqueous solution which contains a chemical reagent with 2 to 6 functional groups able to react with cellulose.

PCT-WO 94/09191 suggests that the functional groups of a chemical reagent, with which the fibres are treated, are electrophilic C=C double compounds and other reactive groups for cellulose.

These suggestions have in common that a reduction in fibrillation tendency of the fibres is achieved by chemically modifying the fibre by the addition of cationic compounds to the hydroxyl groups, which display a negative potential, and on the other hand, by the development of covalent bonds of the cellulose with the reactive groups of the compounds with the resultant crosslinking of the fibrils.

Other papers such as the pending application AT 1348/93 from the applicant, are concerned with the possibility of likewise reducing the tendendy to fibrillation by deliberately varying spinning parameters such as the output, length of the air gap, drawing and air humidity in the air gap.

Surprisingly it has been found that an effective reduction in fibrillation tendency can be achieved when the precipitation bath, into which the fibre is led via an air gap following extrusion whilst being drawn, is basically made up of a non-aqueous solvent for the tertiary amine oxide, in particular NMMO, whereby the molecular weight of the non-aqueous solvent is larger than that of the tertiary amine oxide.

Normally cellulosic fibres are spun from a solution in a tertiary amine oxide into an aqueous precipitation bath.

SU-1 224 362 A on the other hand, describes a process for the manufacture of cellulose fibres with a spinning bath which is characterised in that it contains, amongst other substances, Isopropanol or Isobutanol or mixtures of both with 5–40% NMMO and 0.8–10% water with the aim of increasing elongation at break, reducing shrinkage at raised temperatures and maintaining elongation in the wet condition. The use of Isoamylalcohol is also indicated in one example.

The publications Romanov V. V., Lunina O. B., Mil kova L. P. and Kulichikhin V. G., *Khim. Volokna* (1989) No. 1. p. 29. Romanov V. V., Lunina O. B., Milkova L. P., Brusentova V. G. and Kulichikhin V. G., *Khim. Volokna* (1989) no. 4, p.33 and Romanov V. V. and Sokira A. N., *Khim. Volokna* (1988) no. 1, p. 27 describe the application of Isapropanol and Isobutanol in the spinning bath.

The publications I. Quenin, "Precipitation de la cellulose à partir de solutions dans les oxydes d'amines tertiaires: application au filage" Dissertation Grenoble 1985 and M. Dubé and R. H. Blackwell, "Precipitation and crystallization of cellulose from amine oxide solutions" TAPPI Proceedings, International Dissolving and Speciality Pulps, Boston 1983 examine the extent of cellulose crystallization when spinning in methanol.

The fibrillation behaviour of fibres spun from amine oxide is mentioned in P. Weigel, J. Gensrich and H. P. Fink "Challenges in Cellulosic Man-Made Fibres" Viscose Chemistry Seminar, Stockholm 1994. According to this paper spinning in Isopropanol appears to produce a marked improvement.

All of these publications have in common the fact that low molecular substances are used as a precipitation agent for the spinning bath with a molecular weight clearly smaller than the molecular weight of the amine oxide used. The molecular weight of NMMO equals 117 g/mol.

SUMMARY OF THE INVENTION

Surprisingly, the fibrillation behaviour of the spun fibres clearly improves when substances are used in the spinning bath which display a higher molecular weight than the amine oxide used. According to the process according to this invention, the spinning bath substantially comprises these substances i.e. additional small amounts of addition agents may be present in the spinning bath. Small amounts of up to 10% of tertiary amine oxide or water can also be added to the spinning bath without limiting the effect according to the invention of the application of non-aqueous solvent for the amine oxide.

DETAILED DESCRIPTION OF THE PREFERRED EMBODIMENTS

Certain glycols, glycolether, polyglycols and polyglycolether have proved to be particularly suitable for application in the process according to the invention. It has been shown that a very good fibrillation behaviour can be achieved in the fibres using polyethylene glycols in particular.

The process according to this invention can be used in a particularly effective way when the tertiary amine oxide used is N-methyl-morpholine-N-oxide.

Regarding spinning solutions, all known compositions can be considered for the process according to the invention. Common pulps can be used as the feedstock, as can pulp mixtures. The pulp concentration in the spinning mass can vary between 5 and 25%. Cellulose contents of between 10 and 18% are, however, preferable.

EXAMPLES

Test Apparatus

This is a melt index instrument of the company Davenport commonly used in plastic processing. The instrument is made of a heated cylinder able to be temperature-regulated, into which the spinning dope is filled. Using a piston, the propulsive force of which is controlled via an engine, the spinning dope is extruded through the spinneret attached to the lower side of the cylinder. This is a dry-wet spinning process, as described in the basic patents of the Lyocell technology, i.e. the filament is immersed into a spinning bath (20 cm immersion path in the bath) following the air gap as indicated in the examples, and is drawn off via a galette.

Conditions

Spinning dope: 12% pulp/76% NMMO/12% water

Spinning temperature: 110° C.

Spinneret hole diameter: 100 $\mu$m

Temperature in the air gap: 22°–27° C., 12–16% relative humidity

These parameters are kept constant for the tests. Spinning was carried out in spinning baths of 13 different non-aqueous solvents and finally the fibrillation behaviour of the fibres was measured.

Measurement of Fibrillation Behaviour

The abrasion of the fibres among each other during the washing process respectively during finishing processes in the wet condition was simulated by the following text: 8 fibres were introduced to a 20 ml sample bottle with 4 ml of water and shaken over a nine hour period in a laboratory mechanical shaker of the type RO- 10 from of the company Gerhardt, Bonn (FRG) at level 12. Following this, the fibrillation behaviour of the fibres was evaluated under the microscope by counting the number of fibrils for each 0.276 mm of fibre length and reported in terms of a mark for fibrillation tendency of 0 (no fibrils) to 6 (pronounced fibrillation).

TABLE 1

| Example No. | Substance in spinning bath | Molecular weight (g/mol) | Spinning bath temperature (°C.) | Output g/hole/min | Fibrillation mark |
|---|---|---|---|---|---|
| Comparison | Water | 18 | 25 | 0.025 | 5.0/5.0 |
| 1a | Isopropanol | 60 | 25 | 0.025 | 4.0/4.5 |
| 1b | | | | 0.05 | 5.0/5.0 |
| 1c | | | | 0.1 | 4.75/5 |
| 2a | Glycerine | 92 | 25 | 0.025 | 4.0/4.0 |
| 2b | | | | 0.05 | 4.0/4.0 |
| 2c | | | | 0.1 | 4.0/4.0 |
| 2d | | | 50 | 0.025 | 3.0/4.0 |
| 2e | | | | 0.05 | 4.0/3.5 |
| 2f | | | | 0.1 | 4.0/4.0 |
| 3a | Diethylen-glycol | 106 | 25 | 0.025 | 3.5/3.75 |
| 3b | | | | 0.05 | 3.0/2.5 |
| 3c | | | | 0.1 | 4.5/4.75 |

TABLE 1-continued

| Example No. | Substance in spinning bath | Molecular weight (g/mol) | Spinning bath temperature (°C.) | Output g/hole/min | Fibrillation mark |
|---|---|---|---|---|---|
| 3d | | | 50 | 0.025 | 3.75 |
| 4a | Triethanol-amine | 149 | 25 | 0.025 | 3.5/3.0 |
| 4b | | | | 0.05 | 3.0/2.5 |
| 4c | | | | 0.1 | 4.0/4.0 |
| 5a | Butylpoly-glycol | 161–337 | 25 | 0.025 | 1.0/1.5 |
| 6a | Tetraethylen-glycol-dimethyl-ether | 222 | 25 | 0.025 | 3.0/2.5 |
| 6b | | | 50 | 0.025 | 2.0/2.0 |
| 7a | Polyethylene glycol 200 | 200 | 25 | 0.025 | 2.5/2.5 |
| 7b | | | | 0.05 | 3.0/2.5 |
| 7c | | | 50 | 0.025 | 3.5/3.0 |
| 8a | Polyethylene glycol 300 | 300 | 25 | 0.025 | 2.0/2.0 |
| 8b | | | | 0.05 | 3.5/3.0 |
| 8c | | | 50 | 0.025 | 3.5/3.0 |
| 8d | | | | 0.05 | 2.5/2.5 |
| 9a | Polyethylene glycol 400 | 400 | 25 | 0.025 | 2.5/3 |
| 9b | | | | 0.05 | 2.5/2.0 |
| 9c | | | | 0.1 | 2.5/2.5 |
| 9d | | | 50 | 0.025 | 1.5/1.5 |
| 9e | | | | 0.05 | 1.5/1.0 |
| 9f | | | | 0.1 | 1.5/1.0 |
| 10a | Polyethylene glycol 500 | 500 | 25 | 0.05 | 0.5/0.5 |
| 10b | | | | 0.1 | 0.5/0 |
| 10c | | | 50 | 0.025 | 0.5/1.0 |
| 10d | | | | 0.05 | 0.5/0.5 |
| 10e | | | | 0.1 | 0/0.5 |
| 11a | Polyethylene glycol 600 | 600 | 25 | 0.025 | 0–1.5/0–1.5 |
| 11b | | | | 0.05 | 0–1.5/0–1.5 |
| 11c | | | | 0.1 | 0/1 |
| 11d | | | 50 | 0.025 | 0–2/0.5 |
| 11e | | | | 0.05 | 0.5/0.5 |
| 11f | | | | 0.1 | 0.5/0.5 |
| 12a | Polyethylene glycol 1000 | 1000 | 40 | 0.025 | 1.0/1.0 |
| 13a | Polyethylene glycol 3000 | 3000 | 60 | 0.025 | 0/0.5 |
| 13b | | | | 0.05 | 0.5/0.5 |

Note:
With regard to columns which are not filled in, the value of the last entry applies. Double values with respect to fibrillation marks mean the average values of two independent series of measurements on 8 individual fibres.

From the table it is clear that with respect to comparable test conditions, organic solvents with a molecular weight clearly below that of NMMO, produce no clear improvement in the fibrillation tendency of the spun fibres. In particular in contrast to the literature, an improvement of this kind can likewise not be observed with respect to Isopropanol. Beginning with a molecular weight, which is the same or higher than that of NMMO, a clear improvement in fibrillation tendency can be observed. This improvement is particularly pronounced with molecular weights of more than 200 g/mol. With respect to polyethylene glycols of a higher molecular weight, even fibres with fibrillation marks of between 0 or 0.5 can be manufactured which means, that no or practically no more fibril separation takes place. The use of polyethylene glycols with a very high molecular weight (more than 3000) is only limited by the fact that these compounds must be heated to higher temperatures, e.g. approx. 50° C., for use in the spinning bath.

As can be seen from the table, the output has no considerable influence on the fibrillation behaviour of the fibres. In particular no marked deterioration of the fibrillation tendency can be determined in the transition to higher rates of output. In contrast to other well-known processes, it is possible, therefore, to manufacture fibres with a low fibrillation rate even with higher outputs (e.g. 0.1 g/hole/min) which makes a more economical mode of procedure possible.

What is claimed is:

1. A process for the preparation of cellulose moulded bodies including filaments comprising:

dissolving cellulose in a mixture which comprises a tertiary amine oxide and a non-solvent for cellulose thereby forming a solution, extruding the solution via a moulding tool, thereby forming a filament, and conveying the filament through the air gap into a precipitation bath while drawing the filament, wherein the precipitation bath comprises a non-aqueous solvent for the tertiary amine oxide and the molecular weight of the non-aqueous solvent for the tertiary amine oxide is greater than the molecular weight of the tertiary amine oxide.

2. A process for making cellulose moulded bodies according to claim 1, wherein the non-solvent for cellulose is water.

3. A process for making cellulose moulded bodies according to claim 1, wherein the non-aqueous solvent for the tertiary amine oxide is selected from the group consisting of glycols, glycol ethers, polyglycols and polyglycol ethers.

4. A process for making cellulose moulded bodies according to claim 3, wherein the non-aqueous solvent is polyethylene glycol.

5. A process for making cellulose moulded bodies according to claim 1, wherein the tertiary amine oxide is N-methylmorpholine-N-oxide.

6. A process for making cellulose moulded bodies according to claim 2, wherein the tertiary amine oxide is N-methylmorpholine-N-oxide.

7. A process for making cellulose moulded bodies according to claim 3, wherein the tertiary amine oxide is N-methylmorpholine-N-oxide.

8. A process for making cellulose moulded bodies according to claim 4, wherein the tertiary amine oxide is N-methylmorpholine-N-oxide.

* * * * *